US008154484B2

(12) United States Patent
Choi

(10) Patent No.: US 8,154,484 B2
(45) Date of Patent: Apr. 10, 2012

(54) ORGANIC LIGHT EMITTING DISPLAY AND DRIVING METHOD THEREOF WITH REDUCED POWER CONSUMPTION

(75) Inventor: Sang-Moo Choi, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 775 days.

(21) Appl. No.: 12/211,715

(22) Filed: Sep. 16, 2008

(65) Prior Publication Data

US 2009/0140956 A1 Jun. 4, 2009

(30) Foreign Application Priority Data

Nov. 30, 2007 (KR) ..... 10-2007-0123375

(51) Int. Cl.
*G09G 3/32* (2006.01)

(52) U.S. Cl. ..... 345/82

(58) Field of Classification Search ..... 345/76, 345/77, 82, 83, 211, 212
See application file for complete search history.

(56) References Cited

U.S. PATENT DOCUMENTS

| | | | | |
|---|---|---|---|---|
| 7,557,802 | B2 * | 7/2009 | Hayafuji et al. | 345/212 |
| 2004/0150594 | A1 * | 8/2004 | Koyama et al. | 345/82 |

FOREIGN PATENT DOCUMENTS

| | | | |
|---|---|---|---|
| JP | 2004-205704 | A | 7/2004 |
| KR | 10-2005-0051074 | | 6/2005 |
| KR | 10-2005-0112863 | | 12/2005 |
| KR | 10-2005-0117464 | | 12/2005 |
| KR | 10-0685843 | B1 | 2/2007 |
| KR | 10-2007-0071722 | | 7/2007 |
| KR | 2007-0069078 | A | 7/2007 |

OTHER PUBLICATIONS

Korean Office action dated Jan. 30, 2009 for corresponding Korean application KR 10-2007-0123375.
KIPO Office action dated Jun. 25, 2009, for priority Korean application 10-2007-0123375, noting listed reference in this IDS, as well as KR 10-0685843, KR 10-2007-0069078 and JP 16-205704, previously filed in an IDS dated Mar. 11, 2009.

* cited by examiner

*Primary Examiner* — Chanh Nguyen
*Assistant Examiner* — Allison Walthall
(74) *Attorney, Agent, or Firm* — Christie, Parker & Hale, LLP

(57) ABSTRACT

An organic light emitting display and a driving method thereof capable of reducing power consumption. A driving transistor controls a current through an organic light emitting diode of the display. A voltage controller supplies a first voltage to the anode of the OLED of at least one specific pixel and controls the cathode voltage of the OLED in correspondence to a second current through the OLED, such that the cathode voltage corresponds to the first voltage supplied to the OLED. Thus, the driving transistor can be driven in saturation mode with consistent current in spite of process variations, with a reduced power consumption.

14 Claims, 4 Drawing Sheets

ORGANIC LIGHT EMITTING DISPLAY AND DRIVING METHOD THEREOF WITH REDUCED POWER CONSUMPTION

CROSS-REFERENCE TO RELATED APPLICATIONS

This application claims the benefit of Korean Patent Application No. 10-2007-0123375, filed on Nov. 30, 2007, in the Korean Intellectual Property Office, the entire content of which is incorporated herein by reference.

BACKGROUND

1. Field of the Invention

The present invention generally relates to an organic light emitting display and a driving method thereof.

2. Description of Related Art

Recently, various flat panel display devices having reduced weight and volume in comparison to a cathode ray tube (CRT) have been developed. Examples of flat panel display devices include liquid crystal displays, field emission displays, plasma display panels, organic light emitting displays, etc.

Among these examples, the organic light emitting display displays an image utilizing organic light emitting diodes (OLEDs) that generate light by the recombination of electrons and holes. An organic light emitting display generally has a rapid response speed and a low power consumption.

FIG. 1 is a circuit diagram illustrating a pixel of a conventional organic light emitting display.

Referring to FIG. 1, a pixel 4 of a conventional organic light emitting display includes an organic light emitting diode OLED and a pixel circuit 2 that is coupled to a data line Dm and a scan line Sn to control the organic light emitting diode OLED.

An anode electrode of the organic light emitting diode OLED is coupled to the pixel circuit 2, and a cathode electrode thereof is coupled to a second power ELVSS. The organic light emitting diode OLED generates light having a brightness (which may be predetermined) corresponding to a current supplied from the pixel circuit 2.

The pixel circuit 2 controls an amount of current supplied to the organic light emitting diode OLED in accordance with a data signal supplied to the data line Dm when a scan signal is supplied to the scan line Sn. To this end, the pixel circuit 2 includes a second transistor M2 coupled between a first power ELVDD and the organic light emitting diode OLED, and a first transistor M1 coupled to the second transistor M2, the data line Dm and the scan line Sn, and a storage capacitor Cst coupled between a gate electrode and a first electrode of the second transistor M2.

A gate electrode of the first transistor M1 is coupled to the scan line Sn, and a first electrode thereof is coupled to the data line Dm. And, a second electrode of the first transistor M1 is coupled to one terminal of the storage capacitor Cst. Herein, the first electrode is set as one of a source electrode or a drain electrode, and the second electrode is set as an electrode different from the first electrode. For example, if the first electrode is a source electrode, the second electrode is a drain electrode, and vice versa. The first transistor M1 coupled to the scan line Sn and the data line Dm supplies a data signal on the data line Dm to the storage capacitor Cst by being turned on when the scan signal is supplied from the scan line Sn. At this time, the storage capacitor Cst is charged with a voltage corresponding to the data signal.

A gate electrode of the second transistor M2 is coupled to one terminal of the storage capacitor Cst, and a first electrode thereof is coupled to the other terminal of the storage capacitor Cst and the first power ELVDD. And, a second electrode of the second transistor M2 is coupled to an anode electrode of the organic light emitting diode OLED. The second transistor M2 controls an amount of current flowing from the first power ELVDD, through the organic light emitting diode OLED, to the second power ELVSS in accordance with a voltage stored in the storage capacitor Cst. At this time, the organic light emitting diode OLED generates light corresponding to the amount of current supplied by the second transistor M2.

In the conventional pixel 4, the second transistor M2 is driven as a substantially constant current source supplying a current (e.g., a predetermined current) to the organic light emitting diode OLED in accordance with the voltage stored in the storage capacitor Cst. Herein, the transistor M2 should be driven in its saturation region in order that the second transistor M2 drives a substantially constant current. Therefore, the voltage of the first power ELVDD and the second power ELVSS are set so that the second transistor M2 is driven in the saturation region.

In more detail, the voltage between the first power ELVDD and the second power ELVSS can be expressed as shown in the following Equation 1:

$$ELVDD-ELVSS>Vds_sat+Voled+Vmt+Vmo \quad \text{Equation 1}$$

In Equation 1, Vds_sat represents a minimum voltage between the first electrode and the second electrode (e.g., the source and the drain) of the second transistor M2 for driving the second transistor M2 in the saturation region when a maximum current (i.e., the saturation current of the second transistor M2 when the data value representing the highest gray level is supplied on the data line Dm and stored in the storage capacitor Cst) flows from the pixel circuit 2 to the organic light emitting diode OLED. Voled represents a voltage applied to the organic light emitting diode OLED when the maximum current is supplied.

Vmt represents voltage margin due to a process deviation of the second transistor M2, and Vmo represents a voltage margin corresponding to the process deviation and the temperature characteristics of the organic light emitting diode OLED.

Actually, in the organic light emitting diode OLED, the voltage margin Vmo corresponding to the temperature changes even in the case where the same current is supplied. Therefore, Vmo is set such that the pixel 4 can be stably driven in consideration of the temperature characteristics of the organic light emitting diode OLED.

Meanwhile, when the voltages of the first power ELVDD and the second power ELVSS are set as shown in Equation 1, power consumption may be undesirably high. In particular, the voltage margin Vmo that is added in consideration of the temperature characteristics may result in 20% to 30% of the power consumption. Therefore, a method capable of reducing power consumption by lowering the margin voltage of Vmo is desired.

SUMMARY

To address these and other issues, an organic light emitting display and a driving method thereof having features of an exemplary embodiment of the present invention is capable of reducing power consumption by lowering the voltage margin corresponding to process deviations and the temperature characteristics of the organic light emitting diode OLED.

According to an exemplary embodiment of the present invention, an organic light emitting display includes first and second power generators for generating first and second powers, respectively. A plurality of pixels within the display each include an organic light emitting diode (OLED). At least some pixels among the plurality of pixels are in a display region of the organic light emitting display, and the at least some pixels each include a driving transistor for controlling a first current through the OLED. A voltage controller supplies a second current to the OLED of at least one specific pixel of the plurality of pixels, and controls a voltage of the second power supply in correspondence to a first voltage of the OLED provided when the second current is supplied to the OLED.

In a further exemplary embodiment, the voltage controller includes a controller for controlling a turn-on and a turn-off of the first transistor, the controller comprising a memory for storing first data representing a saturation voltage for driving the driving transistor in a saturation region, and a margin voltage corresponding to a range of process deviation of the driving transistor when the driving transistor supplies a maximum current; and a register for generating second data, wherein the register is configured to adjust a value of the second data in accordance with a comparator output; a first digital-analog converter for converting the first data into a second voltage; a current source for supplying the second current to the OLED when the first transistor is turned on; an adder for adding the first voltage and the second voltage to generate a third voltage; a comparator for comparing the third voltage with a voltage of the first power, and for supplying the comparator output; and a second digital-analog converter for converting the second data to an analog voltage.

According to another exemplary embodiment of the present invention, a method is provided for driving an organic light emitting display including a first power, a second power, an organic light emitting diode, and a pixel circuit comprising a driving transistor for controlling a current through the organic light emitting diode. In this embodiment, the method includes storing first data representing a saturation voltage for driving the driving transistor in a saturation region, and a margin voltage corresponding to a range of process deviation of the driving transistor when the driving transistor supplies a current corresponding to a highest gray level; supplying a first current to an OLED of at least one specific pixel; comparing a third voltage with a voltage of the first power, the third voltage comprising a sum of a first voltage extracted from the OLED while supplying the first current and a second voltage generated by converting the first data to an analog signal; and controlling a voltage of the second power in accordance with a result of comparing the third voltage with the voltage of the first power.

BRIEF DESCRIPTION OF THE DRAWINGS

The accompanying drawings, together with the specification illustrate exemplary embodiments of the present invention, and, together with the description, serve to explain the principles of the present invention.

DETAILED DESCRIPTION OF EXEMPLARY EMBODIMENTS

Figure 1:
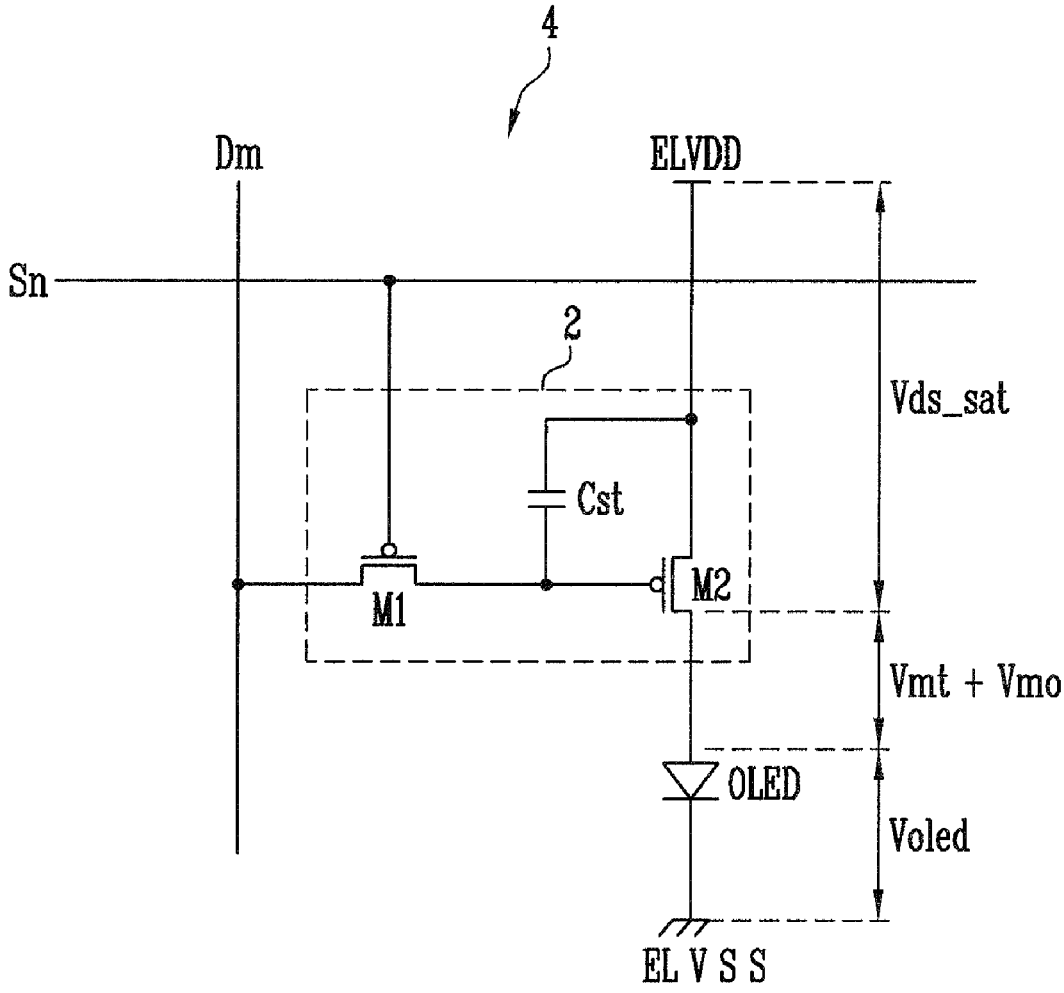
FIG. 1 (RELATED ART)
FIG. 1 is a circuit diagram illustrating a conventional pixel in the related art.

Hereinafter, certain exemplary embodiments of the present invention will be described with reference to the accompanying drawings. Herein, when a first element is described as being coupled to a second element, the first element may be directed coupled to the second element, or it may be indirectly coupled to the second element via a third element. Further, some of the elements that may not be essential for a complete understanding of the invention have been omitted for clarity. Like reference numerals refer to like elements throughout.

Hereinafter, certain exemplary embodiments of the present invention, which can be easily carried out by those skilled in the art, will be described with reference to the accompanying FIGS. 2 through 4.

Figure 2:
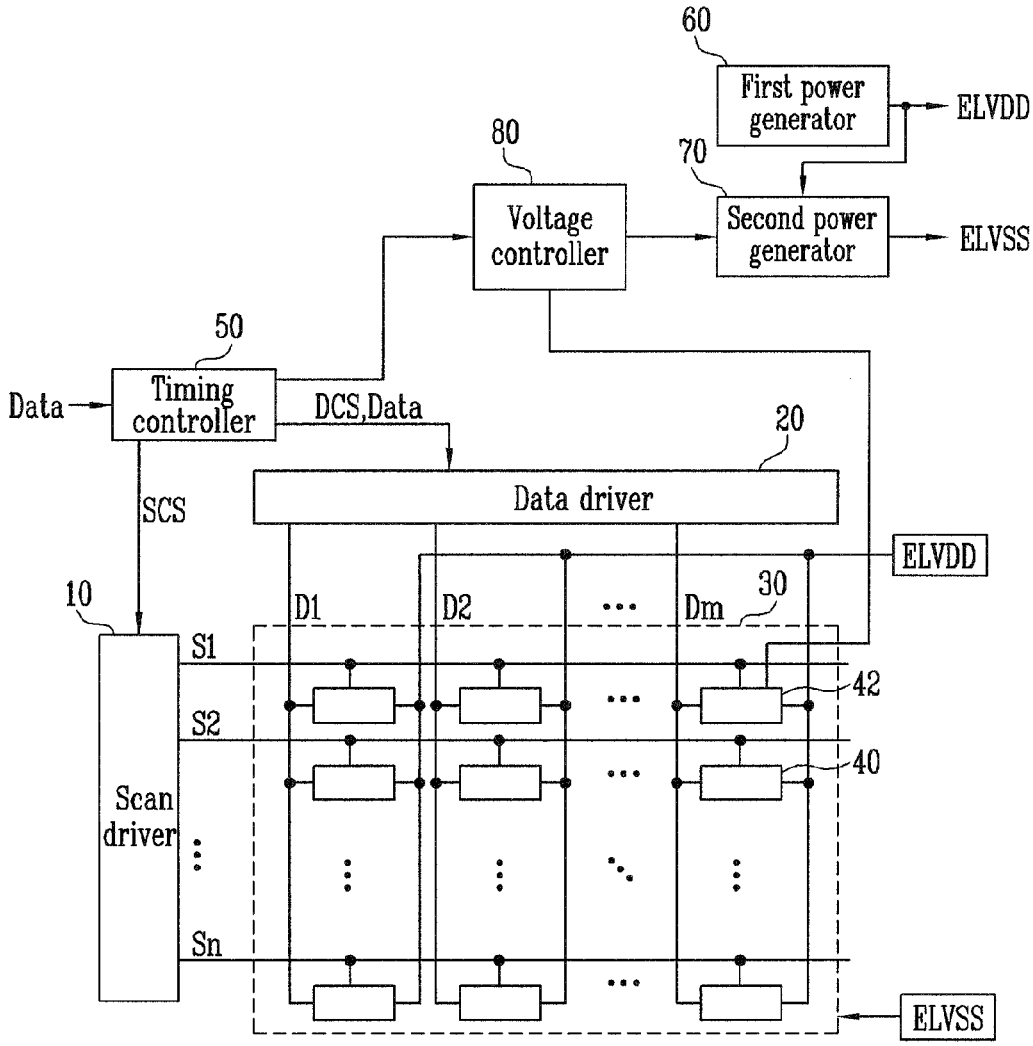
FIG. 2 is a block diagram illustrating an organic light emitting display according to a first exemplary embodiment of the present invention.

FIG. 2 is a block diagram illustrating an organic light emitting display according to an exemplary embodiment of the present invention.

Referring to FIG. 2, the organic light emitting display according to the exemplary embodiment of the present invention displays images during a plurality of frames, and includes a display region (or display unit) 30 that includes a plurality of pixels 40 and 42 coupled to scan lines S1-Sn and data lines D1-Dm, a scan driver 10 that drives the scan lines S1-Sn, a data driver 20 that drives the data lines D1-Dm, and a timing controller 50 that controls the scan driver 10 and the data driver 20.

The organic light emitting display according to the exemplary embodiment of the present invention further includes a first power generator 60 that generates first power ELVDD, a voltage controller 80 that controls a second power generator 70 corresponding to a voltage extracted from a pixel (e.g., a specific pixel) 42, and a second power generator 70 that generates a second power ELVSS under the control of the voltage controller 80.

In the display region 30, the first power ELVDD from the first power generator 60 and the second power ELVSS from the second power generator 70 are coupled to the pixels 40 and 42. When the scan driver 10 supplies the scan signal, the respective pixels 40 and 42 coupled to the first power ELVDD and the second power ELVSS are selected, and emit light at a brightness corresponding to the data signal supplied by the data driver 20.

To this end, the respective pixels 40 and 42 include an organic light emitting diode (not illustrated in FIG. 2) and a pixel circuit (not illustrated in FIG. 2) that supplies current to the organic light emitting diode. The pixel circuit, which typically includes at least one transistor and capacitor, controls an amount of current supplied from the first power ELVDD to the second power ELVSS via the organic light emitting diode, in accordance with the data signal. The organic light emitting diode emits red, green, or blue light in accordance with the amount of current supplied from the pixel circuit.

The scan driver 10 sequentially supplies the scan signals to the scan lines S1-Sn. If the scan signals are sequentially supplied to the scan lines S1-Sn, rows of pixels 40 and 42 are sequentially selected.

The data driver 20 generates data signals using data supplied from the timing controller 50, and supplies the generated data signals to the data lines D1-Dm whenever the scan signals are supplied. Then, the data signals are supplied to the pixels 40 and 42 selected by the scan signals.

The timing controller 50 generates a data driving control signal DCS and a scan driving control signal SCS that correspond to synchronization signals supplied from the outside.

The data driving control signal DCS generated from the timing controller 50 is supplied to the data driver 20, and the scan driving control signal SCS generated therefrom is supplied to the scan driver 10. And, the timing controller 50 rearranges data supplied from the outside to supply it to the data driver 20.

The voltage controller 80 is coupled to at least one specific pixel 42 included in the display region 30. The voltage controller 80 extracts a voltage applied to the organic light emitting diode of the specific pixel 42, while supplying a reference current (e.g., a predetermined current) to the specific pixel 42. At this time, the voltage extracted from the organic light emitting diode includes voltage information applied to the organic light emitting diode corresponding to the temperature currently driven (i.e., Vmo+Voled). The voltage controller 80 extracting a voltage of the pixel 42 controls the second power generator 70 to minimize or reduce power consumption.

The second power generator 70 generates second power ELVSS corresponding to the signal from the voltage controller 80 (described below) and supplies the generated second power ELVSS to the pixels 40 and 42.

The first power generator 60 generates first power ELVDD and supplies the generated first power ELVDD to the pixels 40 and 42.

In FIG. 2, the voltage controller 80 is illustrated as being coupled to the specific pixel 42 included in the display region 30, but the present invention is not limited thereto. In practice, as shown in FIG. 3, the voltage controller 80 may be coupled to at least one dummy pixel 44 positioned in a region (i.e., a non-display region) other than the display region 30.

Figure 3:
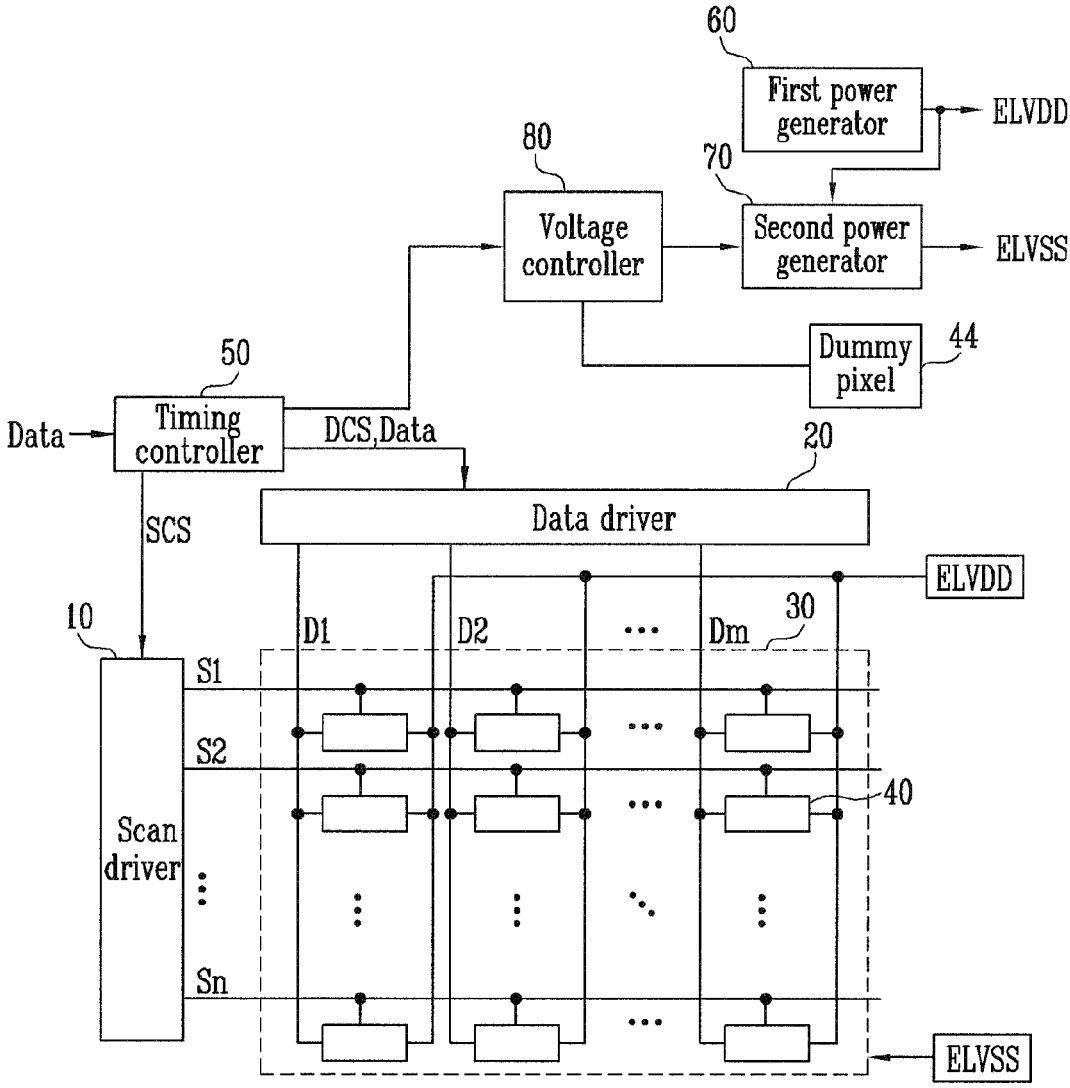
FIG. 3 is a block diagram illustrating an organic light emitting display according to a second exemplary embodiment of the present invention.
Figure 4:
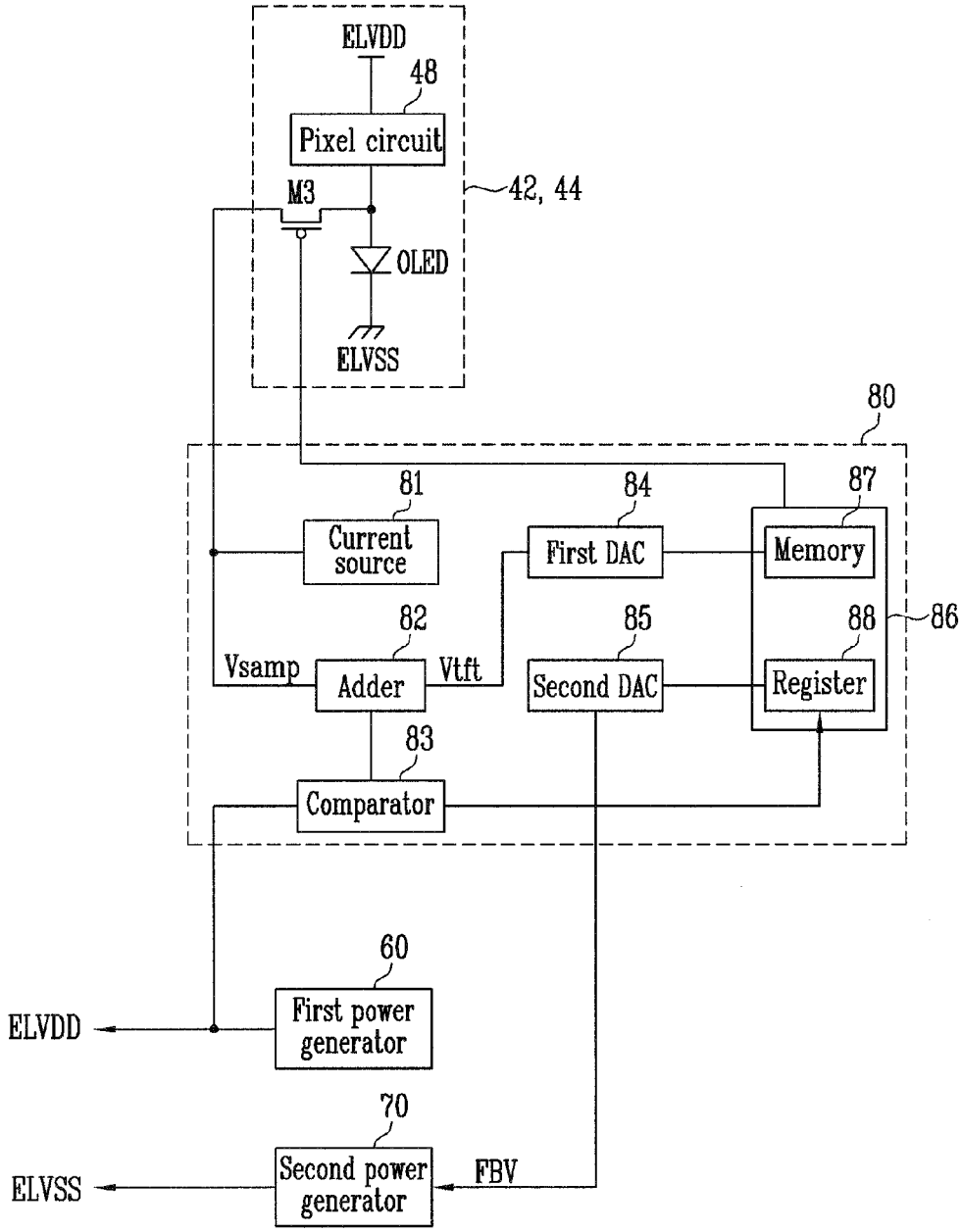
FIG. 4 is simplified schematic diagram illustrating the voltage controller and the pixel of FIGS. 2 and 3.

FIG. 4 is simplified schematic diagram illustrating the voltage controller 80 and the pixel 42, 44 of FIGS. 2 and 3.

Referring to FIG. 4, the pixel 42, 44 includes a pixel circuit 48 that supplies current to an organic light emitting diode OLED, whereby the organic light emitting diode OLED emits light corresponding to the current supplied from the pixel circuit 48, and a first transistor M3 coupled between an anode electrode of the organic light emitting diode OLED and a voltage controller 80.

Herein, when the pixel as shown in FIG. 4 is the dummy pixel 44, the first transistor M3 is turned on every $i^{th}$ (i is a natural number) frame period. When the first transistor M3 is turned on, the voltage controller 80 supplies a current, e.g., a maximum current corresponding to the brightest gray level, to the organic light emitting diode OLED. At this time, the pixel circuit 48 blocks an electrical coupling between a first power ELVDD and the organic light emitting diode OLED. Actually, when a pixel as shown in FIG. 4 is the dummy pixel 44, the pixel circuit 48 and the first power ELVDD may be omitted.

Whenever the first transistor M3 is turned on, the voltage controller 80 controls a voltage of a second power ELVSS in accordance with a voltage applied to the organic light emitting diode OLED. Herein, if a period in between times that the first transistor M3 is turned on is a short period (for example, i=2), the voltage of the second power ELVSS is frequently changed, resulting in frequent changes in the brightness of a panel, which may negatively affect a user's viewing experience. Therefore, i is experimentally determined in consideration of the size and resolution of the panel such that the changes in the brightness of the panel are not necessarily observed by a viewer.

Meanwhile, when the pixel as shown in FIG. 4 is the specific pixel 42 within the display region 30, the first transistor M3 is turned on when the specific pixel does not perform a display operation. For example, the first transistor M3 included in the specific pixel 42 is turned on during a period when the specific pixel displays black. In this case, the voltage controller 80 is supplied with data from a timing controller 50 to the specific pixel 42, and turns on the first transistor M3 when the data displays black (e.g., in the case of having "00000000" bits). As described above, the first transistor M3 is turned on during the period that the specific pixel 42 displays black, thereby not causing a collision between the current (e.g., the predetermined current) supplied from the voltage controller 80 and the current supplied form the pixel circuit 48.

Meanwhile, in the exemplary embodiment described, the voltage controller 80 does not unconditionally turn on the first transistor M3 when the specific pixel 42 displays black. In other words, the voltage controller 80 controls a point of time when the first transistor M3 is turned on such that the change in voltage of the second power ELVSS is not observed by a viewer.

The voltage controller 80 includes a current source 81, an adder 82, a comparator 83, a first digital-analog converter 84 (hereinafter, referred to as "first DAC"), a second DAC 85, and a controller 86.

The current source 81 supplies a current (e.g., a predetermined current) to the organic light emitting diode (OLED) corresponding to a current when the pixels 40 emit light at the highest brightness.

The adder 82 adds a first voltage Vsamp applied to the organic light emitting diode OLED with a second voltage Vtft supplied from the first DAC 84 when the current source 81 supplies the current to the organic light emitting diode OLED, and supplies the sum as a third voltage to the comparator 83.

The comparator 83 compares the third voltage with the voltage of the first power ELVDD, and provides the comparative result to the controller 86.

The controller 86 controls turn-on and turn-off of the first transistor M3. The controller 86 includes a memory 87 and a register 88.

A first data corresponding to a total voltage of VDS_sat and Vmt is stored in the memory. In this exemplary embodiment, VDS_sat and Vmt are set as fixed values in every panel so that they can be previously stored in the memory 87.

The first DAC 84 converts the first data supplied from the memory 87 to the second voltage (Vtft=VDS_sat+Vmt) to supply it to the adder 82.

The register 88 supplies a second data of j (j is a natural number) bits, the value of which increases or decreases in accordance with the comparative result of the comparator 83, to the second DAC 85.

The second DAC 85 converts the second data supplied from the register 88 to analog voltage FBV to supply it to a second power generator 70.

The second power generator 70 generates the second power ELVSS using the analog voltage FBV supplied from the second DAC 85. Herein, the second power ELVSS is generated as shown in the following equation 2:

$$ELVSS=\alpha\times FBV+\Delta V \qquad \text{Equation 2}$$

In Equation 2, $\alpha$ represents a real number larger than 0 and $\Delta V$ represents a voltage, and is also a real number. In Equation 2, $\alpha$ and $\Delta V$ are previously and experimentally determined in order that the second power ELVSS can be stably generated from the analog voltage FBV. Herein, $\alpha$ and $\Delta V$ are set as fixed values so that the voltage of the second power ELVSS is determined by the analog voltage FBV.

Explaining an exemplary operation process in detail, first the first data stored in the memory 87 is supplied to the first DAC 84. The first DAC 84 converts the first data supplied form the memory 87 to the second voltage Vtft to supply it to the adder 82.

The first transistor M3 is turned on by controlling the controller 86. At this time, current is not supplied from the pixel circuit 48 to the organic light emitting diode OLED. If the first transistor M3 is turned on, a current (e.g., a predetermined current) from the current source 81 is supplied to the organic light emitting diode OLED. At this time, the first voltage Vsamp is applied to the organic light emitting diode OLED. Herein, the value of the first voltage Vsamp varies depending on the temperature currently experienced. For example, the first voltage Vsamp may be about 4V at a high temperature (e.g., 80° C.) and may be about 8V at a low temperature (e.g., −30° C.).

The first voltage Vsamp applied to the organic light emitting diode OLED is supplied to the adder 82. At this time, the adder 82 generates the third voltage by adding the first voltage Vsamp and the second voltage Vtft, and supplies the generated third voltage to the comparator 83.

The comparator 83 supplied with the third voltage compares the third voltage with the voltage value of the first power ELVDD and supplies the comparative result to the register 88. For example, when the first power ELVDD has a high voltage, the comparator 83 supplies a first control signal to the register 88, and when the third voltage has a high voltage, the comparator 83 supplies a second control signal to the register 88.

The register 88 increases or decreases the value of the second data in accordance with the control signal supplied from the comparator 83. For example, when the first control signal is input, the comparator 83 increases the value of the second data, and when the second control signal is input, the comparator 83 decreases the value of the second data. In other words, the comparator 83 increases or decreases the value of the second data in order that the third voltage output from the adder 82 has a similar value with the first power ELVDD.

The second DAC 85 converts the second data into the analog voltage FBV to supply it to the second power generator 70.

The second power generator 70 generates the second power ELVSS by using the analog voltage FBV supplied from the second DAC 85. Thereafter, the voltage controller 80 generates an optimal voltage of the second power ELVSS corresponding to the temperature currently driven, repeating the processes as described above.

In summary, the organic light emitting display according to the exemplary embodiment of the present invention extracts the voltage applied to the organic light emitting diode OLED corresponding to the temperature, and controls the voltage of the second power ELVSS corresponding to the extracted voltage. As described above, the voltage of the second power ELVSS is controlled using the voltage extracted from the organic light emitting diode OLED, making it possible to reduce or minimize power consumption. In other words, the voltage of Vmo as shown in Equation 1 is controlled to correspond to the temperature currently driven so that there is no need for an unnecessarily wide margin.

Meanwhile, in another exemplary embodiment of the present invention the voltage controller 80 can be coupled to at least two specific pixels 42 or dummy pixels 44. In this case, the voltage controller 80 repeats the processes as described above in the specific pixel 42 or the dummy pixel 44. And, the register 88 controls the voltage of the second power generator 70 only when the same result is obtained in both or all the specific pixels 42 or the dummy pixels 44, that is, only when the same control signal (the first control signal or the second control signal) is generated in all the specific pixels 42 or the dummy pixels 44.

The organic light emitting display and the driving method thereof according to various exemplary embodiments of the present invention sets the voltage value of the second power ELVSS to correspond to the temperature currently driven, making it possible to reduce power consumption.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

a first power generator for generating a first power;

a second power generator for generating a second power;

a plurality of pixels, each pixel comprising an organic light emitting diode, wherein at least some pixels among the plurality of pixels are in a display region of the organic light emitting display, and the at least some pixels each comprise a driving transistor for controlling a first current through the organic light emitting diode; and a voltage controller for supplying a second current to the organic light emitting diode of at least one specific pixel of the plurality of pixels, and for controlling a voltage of the second power in accordance with a first voltage of the organic light emitting diode provided when the second current is supplied to the organic light emitting diode, wherein each specific pixel comprises a first transistor coupled between the organic light emitting diode of the specific pixel and the voltage controller, and wherein the voltage controller comprises:

a controller for controlling a turn-on and a turn-off of the first transistor, the controller comprising:

a memory for storing first data representing a saturation voltage for driving the driving transistor in a saturation region, and a margin voltage corresponding to a range of process deviation of the driving transistor when the driving transistor supplies a maximum current; and a register for generating second data, wherein the register is configured to adjust a value of the second data in accordance with a comparator output;

a first digital-analog converter for converting the first data into a second voltage;

a current source for supplying the second current to the organic light emitting diode when the first transistor is turned on;

an adder for adding the first voltage and the second voltage to generate a third voltage;

a comparator for comparing the third voltage with a voltage of the first power, and for supplying the comparator output; and a second digital-analog converter for converting the second data to an analog voltage.

2. The organic light emitting display as claimed in claim 1, wherein the register is configured to increase the value of the second data when the comparator indicates that the voltage of the first power is larger than the third voltage, and to decrease the value of the second data when the comparator indicates that the third voltage is larger than the voltage of the first power.

3. The organic light emitting display as claimed in claim 1, wherein the second power generator is configured to decrease the voltage of the second power when the value of the second data decreases, and to increase the voltage of the second power when the value of the second data increases.

4. The organic light emitting display as claimed in claim 1, wherein the second current comprises a substantially same value as the maximum current.

5. The organic light emitting display as claimed in claim 1, wherein the at least one specific pixel comprises at least two specific pixels, the voltage controller is coupled to the at least two specific pixels, and the register is configured to increase or decrease the second data when a same comparative result is generated in the two specific pixels.

6. The organic light emitting display as claimed in claim 1, wherein the specific pixel is in the display region.

7. The organic light emitting display as claimed in claim 6, wherein the controller is configured to turn on the first transistor when the specific pixel displays a black color.

8. The organic light emitting display as claimed in claim 1, wherein the specific pixel is outside the display region.

9. The organic light emitting display as claimed in claim 8, wherein:

the organic light emitting display is adapted to display an image during a plurality of frames; and the controller is configured to turn on the first transistor in every $i^{th}$ (i is a natural number) frame among the plurality of frames.

10. A method of driving an organic light emitting display including a first power, a second power, an organic light emitting diode, and a pixel circuit comprising a driving transistor for controlling a current through the organic light emitting diode, the method comprising:

storing first data representing a saturation voltage for driving the driving transistor in a saturation region, and a margin voltage corresponding to a range of process deviation of the driving transistor when the driving transistor supplies a current corresponding to a highest gray level;

supplying a first current to an organic light emitting diode of at least one specific pixel;

comparing a third voltage with a voltage of the first power, the third voltage comprising a sum of a first voltage extracted from the organic light emitting diode while supplying the first current and a second voltage generated by converting the first data to an analog signal; and controlling a voltage of the second power in accordance with a result of comparing the third voltage with the voltage of the first power.

11. The method of driving the organic light emitting display as claimed in claim 10, wherein controlling the voltage of the second power comprises driving the third voltage to be similar to the voltage of the first power.

12. The method of driving the organic light emitting display as claimed in claim 10, wherein the organic light emitting display comprises a display region and at least one specific pixel is in the display region, the method further comprising supplying the first current when the specific pixel displays a black color.

13. The method of driving the organic light emitting display as claimed in claim 10, wherein:

the organic light emitting display comprises a display region, and is adapted to display an image during a plurality of frames; and the at least one specific pixel is outside the display region, the method further comprising supplying the first current in every ith frame (i is a natural number) among the plurality of frames.

14. The method of driving the organic light emitting display as claimed in claim 10, wherein the at least one specific pixel comprises at least two specific pixels, and controlling the voltage of the second power comprises changing the voltage of the second power when the same comparative result from comparing the third voltage is obtained from each of the at least two specific pixels.

* * * * *